US012788087B2

(12) United States Patent
Salisbury et al.

(10) Patent No.: US 12,788,087 B2
(45) Date of Patent: Nov. 10, 2026

(54) GLOVE FOR ELEVATED WORKING TOOL SECUREMENT

(71) Applicant: TECHNIQUE SOLUTIONS PTY LTD, Tullamarine (AU)

(72) Inventors: Richard Salisbury, Tullamarine (AU); David Salisbury, Tullamarine (AU)

(73) Assignee: GRIPPS GLOBAL PTY LTD AS TRUSTEES FOR DTR GROUP, Tullamarine (AU)

( * ) Notice: Subject to any disclaimer, the term of this patent is extended or adjusted under 35 U.S.C. 154(b) by 172 days.

(21) Appl. No.: 15/752,051

(22) PCT Filed: Aug. 18, 2016

(86) PCT No.: PCT/AU2016/050762
§ 371 (c)(1),
(2) Date: Feb. 12, 2018

(87) PCT Pub. No.: WO2017/027926
PCT Pub. Date: Feb. 23, 2017

(65) Prior Publication Data

US 2018/0235294 A1 Aug. 23, 2018

(30) Foreign Application Priority Data

Aug. 18, 2015 (AU) ..... 2015903341

(51) Int. Cl.
*A41D 19/015* (2006.01)
*A41D 19/00* (2006.01)
(Continued)

(52) U.S. Cl.
CPC ... *A41D 19/01594* (2013.01); *A41D 19/0037* (2013.01); *A41D 19/0048* (2013.01);
(Continued)

(58) Field of Classification Search
CPC ..... A41D 19/0037; A41D 19/0048; A41D 19/01594; A41D 2300/32; A41D 2400/80;
(Continued)

(56) References Cited

U.S. PATENT DOCUMENTS 774,143 A * 11/1904 Adams ..... A45F 5/00 224/220
2,083,604 A * 6/1937 Hay ..... A63B 71/146 2/159

(Continued)

FOREIGN PATENT DOCUMENTS

GB 2467310 B 7/2013
JP 2010159506 A 7/2010

OTHER PUBLICATIONS

Amazon Listing for Mechanix Wear Gloves with first available date of 2012, retrieved by Examiner on Feb. 11, 2021 at https://www.amazon.com/dp/B005YSS0EQ/?th=1 (Year: 2012).*

(Continued)

*Primary Examiner* — F Griffin Hall
(74) *Attorney, Agent, or Firm* — Dickinson Wright PLLC

(57) ABSTRACT

There is provided a glove for elevated working tool securement. The glove comprises an anchor point such that, in use, if a tool tethered to the anchor point is dropped, the anchor point secures the tool to the glove. The glove can further comprise a cuff, such as a user tightenable cuff comprises a band fastening portion, configured such that, in use, if a tool tethered to the anchor point is dropped, the cuff secures the glove tightly to a wrist to withstand the forces exerted on the anchor point.

15 Claims, 9 Drawing Sheets

(51) Int. Cl.
*A45F 5/00* (2006.01)
*A45F 5/02* (2006.01)

(52) U.S. Cl.
CPC ..... *A45F 5/02* (2013.01); *A41D 2300/32* (2013.01); *A41D 2400/80* (2013.01); *A41D 2600/20* (2013.01); *A45F 2005/006* (2013.01); *A45F 5/1575* (2025.01)

(58) Field of Classification Search
CPC ..... A41D 2600/20; A41D 19/00; A41D 19/0034; A41D 19/041; A41D 19/0044; A41D 19/0093; A41D 19/01523; A41D 19/01505; A41D 19/0065; A45F 2005/006; A45F 2200/0575; A45F 5/02; A45F 2200/575; A45F 2005/023; A45F 2005/025; F16B 45/02; A63B 21/4019; A63B 21/04–0557; A41F 1/06
USPC ..... 2/16, 17, 159, 160, 161.1, 161.2, 161.3, 2/161.4, 161.5, 161.6, 161.8, 162
See application file for complete search history.

(56) References Cited

U.S. PATENT DOCUMENTS 2,447,328 A * 8/1948 Gerrits ..... A63B 21/4019 473/205
3,985,364 A * 10/1976 Brady ..... A63B 69/0059 273/DIG. 30
4,253,660 A * 3/1981 Tiktin ..... A63B 21/4019 2/160
4,742,580 A * 5/1988 Phillips, Jr. ..... A41D 19/0041 2/907
5,010,617 A * 4/1991 Nelson ..... A47L 23/10 2/158
5,082,156 A * 1/1992 Braun ..... B25H 3/00 224/220
5,306,222 A * 4/1994 Wilkinson ..... A63B 23/03508 482/121
5,353,440 A * 10/1994 Meldeau ..... A41D 19/01547 2/161.1
5,659,899 A * 8/1997 Soter ..... A41D 19/02 2/160
5,704,066 A * 1/1998 Yamamoto ..... A41D 19/015 2/160
5,752,900 A * 5/1998 Holland, Jr. ..... A63B 21/4025 482/69
5,864,885 A * 2/1999 Grinberg ..... A41D 19/01511 2/159
5,864,925 A * 2/1999 McGee ..... A63B 57/20 24/3.13
5,993,362 A * 11/1999 Ghobadi ..... A63B 21/4015 482/121
6,212,688 B1 * 4/2001 Leslie ..... A41D 19/0041 2/160
6,487,756 B1 * 12/2002 Vidal, Jr. ..... B25H 3/006 242/379.2
7,305,718 B2 * 12/2007 Avallone ..... A41D 19/01582 2/11
8,146,785 B2 * 4/2012 Pruitt ..... B25B 23/00 224/661
9,061,173 B1 * 6/2015 Felkel ..... A63B 69/0059
9,155,376 B2 * 10/2015 Moreau ..... B25H 3/00
2002/0062514 A1 5/2002 Soter
2004/0172735 A1 9/2004 Garland
2006/0015983 A1 * 1/2006 Kim ..... A63B 71/146 2/161.2
2008/0060115 A1 * 3/2008 Morris ..... A41D 19/01523 2/159
2008/0229534 A1 * 9/2008 Vossoughi ..... F26B 5/16 15/227
2010/0071114 A1 * 3/2010 Jaeger ..... A41D 19/01523 2/163
2010/0222189 A1 * 9/2010 Washington ..... A63B 21/0552 482/124
2011/0162127 A1 * 7/2011 Allen ..... A41D 19/01535 2/160
2011/0301001 A1 * 12/2011 Hopper ..... A63B 21/4019 482/121
2012/0060256 A1 * 3/2012 Parker ..... A41D 19/0041 2/85
2012/0100966 A1 * 4/2012 Chen ..... A63B 69/26 482/83
2013/0263356 A1 * 10/2013 Jones ..... A41D 19/0017 2/163
2013/0283498 A1 * 10/2013 Hewitt ..... A63B 71/141 2/161.1
2014/0033392 A1 * 2/2014 Bulan ..... A41D 19/01547 2/16
2014/0173804 A1 * 6/2014 Matos ..... A45F 5/06 24/3.12
2014/0289930 A1 * 10/2014 Moss ..... A63B 71/146 2/161.4
2015/0121605 A1 * 5/2015 Safford ..... A41D 19/01552 2/162
2016/0101309 A1 * 4/2016 Schreiber ..... A63B 21/0442 482/124
2018/0303176 A1 * 10/2018 Lim ..... A41D 19/01505

OTHER PUBLICATIONS

The Tool Tether Anchor Glove Listing, available before Aug. 17, 2015, retrieved by Examiner on Sep. 22, 2023 at https://x1safety.com/products/tether-anchor-glove-flexilite?variant=44112073851198&srsltid=AfmBOor10R5Qt53J5PfLvlsITUp8Wq0YllrigWj_CeW-cf6QELrc7BhNI-Q (Year: 2015).*
International Search Report & Written Opinion dated Oct. 31, 2016 from corresponding PCT Application No. PCT/AU2016/050762.
Tool@rrest—The Drop Stops Here—Lanyards & Accessories, https://www.toolarrest.co.uk/lanywards-and-accessories/, Published on Feb. 22, 2015 as per the wayback machine.

* cited by examiner

GLOVE FOR ELEVATED WORKING TOOL SECUREMENT

FIELD OF THE INVENTION

The present invention relates to personal protective equipment and in particular, but not necessarily entirely, to a glove for elevated working tool securement.

SUMMARY OF THE DISCLOSURE

According to one aspect, there is provided a glove for elevated working tool securement, the glove comprising: an anchor point such that, in use, if a tool tethered to the anchor point is dropped, the anchor point secures the tool to the glove.

The glove may be constructed to withstand over approximately 400 N.

The glove may further comprise a cuff configured such that, in use, if a tool tethered to the anchor point is dropped, the cuff secures the glove tightly to a wrist to withstand the forces exerted on the anchor point.

The anchor point may be operably coupled to the cuff.

The cuff may be a user tightenable cuff in comprising a releasably fastenable offset adjustable band. An inner face of the band and an outer face of the band fastening portion comprise hook and loop fasteners.

The band fastening portion may be located rearwardly.

The cuff may define a proximally-distally orientated slit thereby defining two adjacent respectively offsettable cuff portions and wherein the band may be fastened to a first one of the portions to extend across the slit to fasten to a second one of the portions.

The slit may be laterally located.

The cuff may widen proximally opposite the slit.

The anchor point may be rearwardly located.

The anchor point may be located at a proximally rearward portion.

The anchor point may comprise a ring.

The ring may comprise a D-ring.

The glove may further comprise an anchor point retainer for securing the anchor point.

A strip of material may be folded in two and stitched to the cuff so as to define a distally located loop defining the anchor point and proximal ends defining the anchor point retainer.

The anchor point retainer may be a strip of material orientated along a distal-proximal axis of the glove and stitched at either end to a proximally rearward portion of the glove.

A proximal end of the anchor point retainer may be integrally formed with the cuff.

The proximal end of the anchor point retainer may extend laterally.

A distal end of the anchor point retainer may extend laterally.

The glove may further comprise a rearward surface mounted guard and wherein a distal end of the anchor point retainer may be retained beneath the surface mounted guard.

A distal end of the anchor point retainer extends laterally beneath the surface mounted guard.

Other aspects of the invention are also disclosed.

BRIEF DESCRIPTION OF THE DRAWINGS

Notwithstanding any other forms which may fall within the scope of the present invention, preferred embodiments of the disclosure will now be described, by way of example only, with reference to the accompanying drawings in which.

DESCRIPTION OF EMBODIMENTS

Figure 1:
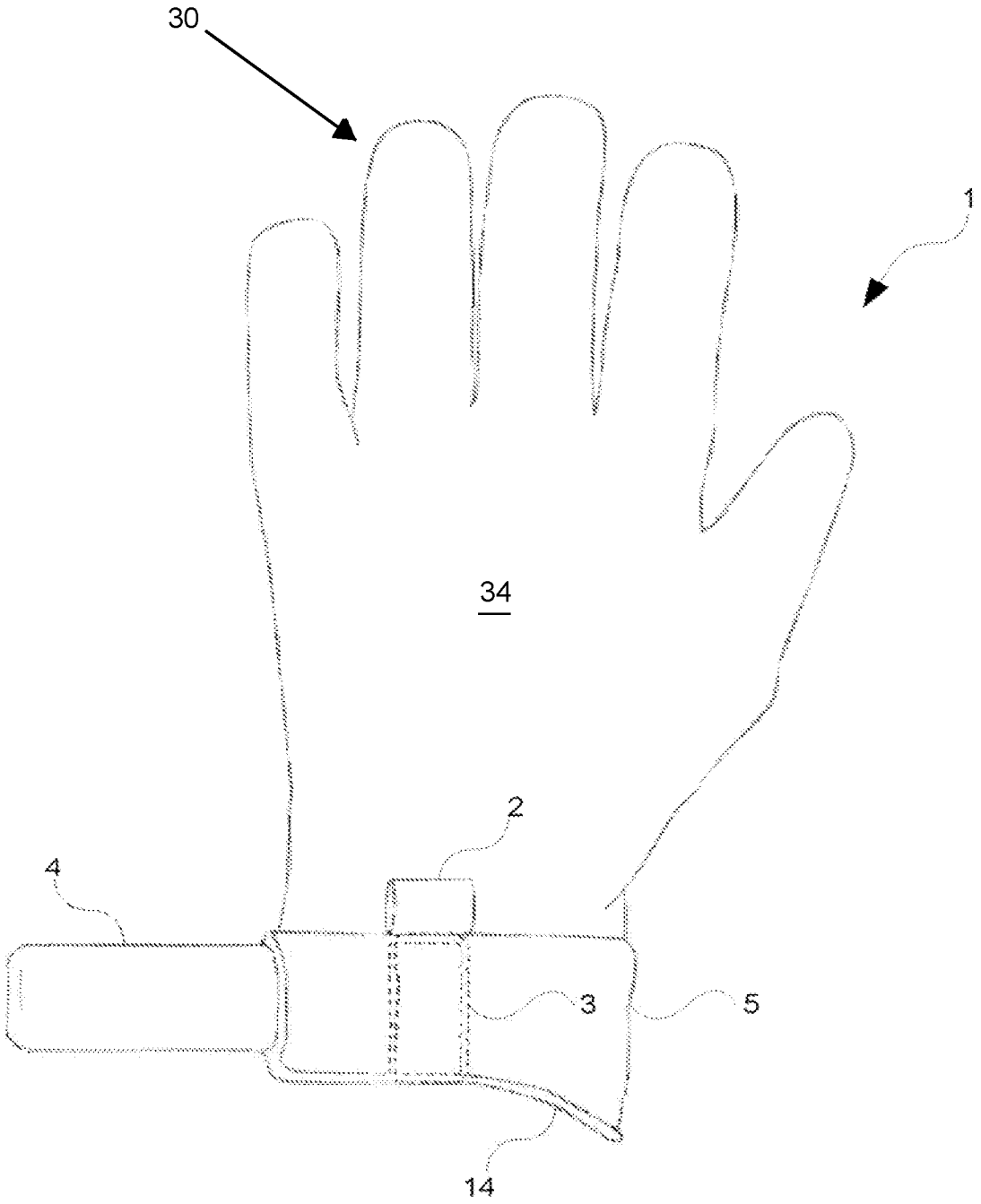
FIGS. 1 and 2 show front and back views of a glove for elevated working tool securement in accordance with an embodiment of the present disclosure.

For the purposes of promoting an understanding of the principles in accordance with the disclosure, reference will now be made to the embodiments illustrated in the drawings and specific language will be used to describe the same. It will nevertheless be understood that no limitation of the scope of the disclosure is thereby intended. Any alterations and further modifications of the inventive features illustrated herein, and any additional applications of the principles of the disclosure as illustrated herein, which would normally occur to one skilled in the relevant art and having possession of this disclosure, are to be considered within the scope of the disclosure.

Before the structures, systems and associated methods relating to the glove for elevated working tool securement are disclosed and described, it is to be understood that this disclosure is not limited to the particular configurations, process steps, and materials disclosed herein as such may vary somewhat. It is also to be understood that the terminology employed herein is used for the purpose of describing particular embodiments only and is not intended to be limiting since the scope of the disclosure will be limited only by the claims and equivalents thereof.

In describing and claiming the subject matter of the disclosure, the following terminology will be used in accordance with the definitions set out below.

It must be noted that, as used in this specification and the appended claims, the singular forms "a," "an," and "the" include plural referents unless the context clearly dictates otherwise.

As used herein, the terms "comprising," "including," "containing," "characterised by," and grammatical equivalents thereof are inclusive or open-ended terms that do not exclude additional, unrecited elements or method steps.

It should be noted in the following description that like or the same reference numerals in different embodiments denote the same or similar features.

The accompanying illustrations show various embodiments of a glove 1 for elevated working tool securement. As will become apparent from the ensuing description, the glove 1 is suitable for securement of tools by way of a tether, lanyard and the like while working at elevated heights so as to be able to arrest the fall of a tool if inadvertently dropped.

Figure 2:
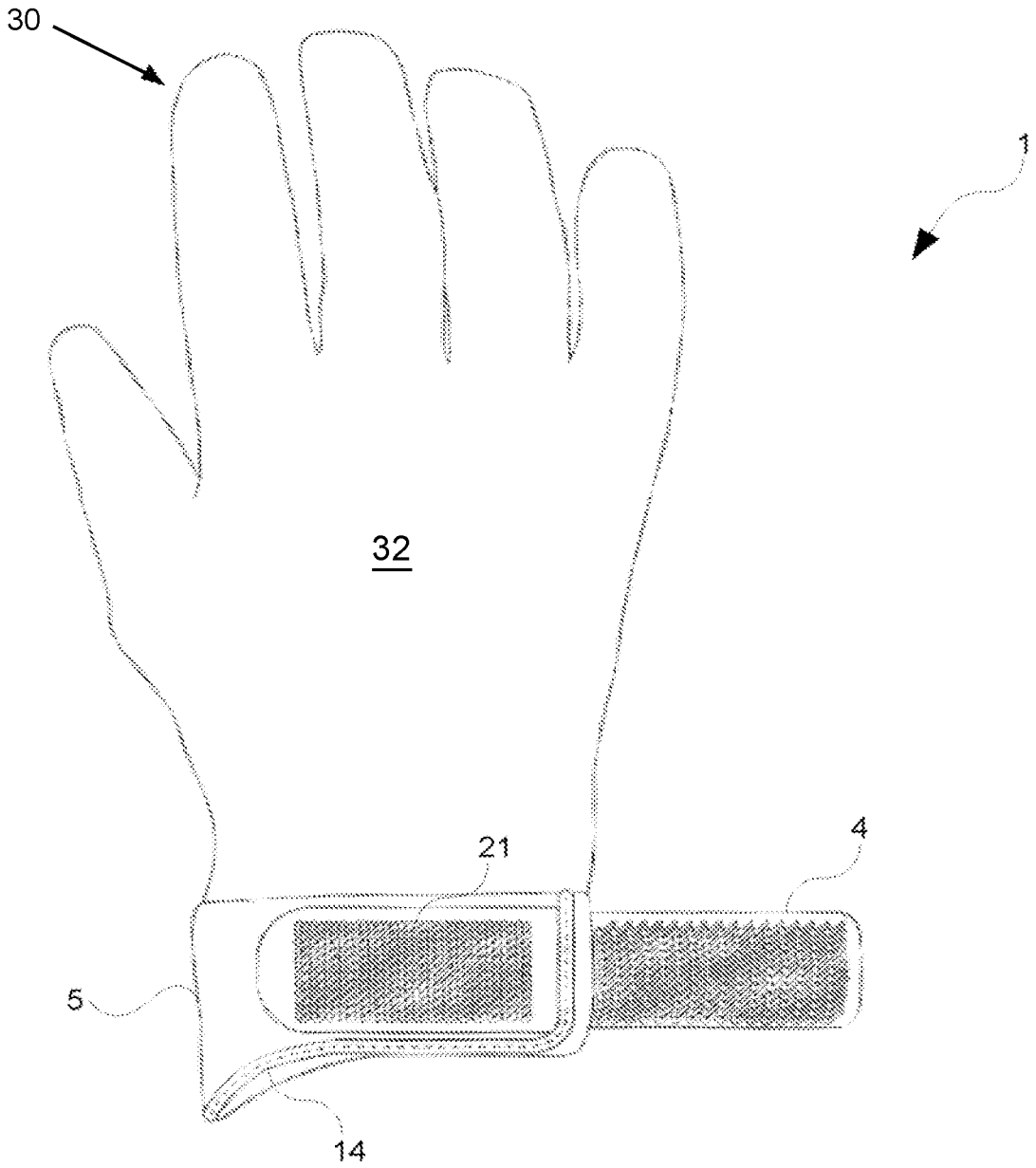

Turning now to FIGS. 1 and 2, there is shown in the glove 1 in accordance with a first embodiment. In general terms, the glove 1 takes the form of a conventional glove arrangement in that it has finger portions for the insertion of fingers thereinto in use so as to cover the front and back of the hand of the user in use. The glove shown in FIGS. 1 and 2 is provided in both left and right and configuration but, front and back illustrations are provided for illustrative convenience.

For convenience of reference, "distally" and variations thereof generally refer to towards the fingertips of the glove 1 whereas "proximally" and variations thereof generally refer to portions of the glove 1 towards the wrist of the user. Furthermore, "rearwardly" and equivalents thereof generally refer to the back of the glove 1 and conversely, "forwardly" refers to the front palm-side of the glove 1.

The work glove 1 is characterized in that it comprises a finger section 30, a palm section 32, a back of glove 34, and a cuff 5. The work glove 1 is configured to receive a user's hand with said finger section 30 configured to completely cover a user's fingers, said palm section 32 configured to cover a user's palm, said back of glove 34 configured to cover the user's back of hand and said cuff 5 configured to surround said user's wrist.

As such, in use, if at tool tethered to the anchor point 2 is dropped, the anchor point 2 secures the tool to the glove 1.

Furthermore, in a preferred embodiment, the glove 1 comprises a cuff 5 configured for tightening around the wrist of the user in use in the manner described herein.

In an embodiment, the cuff 5 may be an elasticised so as to tighten against the wrist of the user.

However, in a further preferred embodiment, the cuff 5 is user tightenable.

As such, the anchor point 2 is operably coupled to the cuff 5 such that, in use, a tool may be tethered by the anchor point 2 for securement. As such, if the tool is inadvertently dropped, the anchor point 2 secures the tool to the glove 1. Furthermore, the tightenable cuff 5 secures the glove 1 to the wrist of the user so as to prevent or reduce the likelihood of the glove 1 being yanked from the hand of the user when the tool pulls against anchor point 2, that is, in other words, the anchor point 2 is "operably coupled" to the tightenable cuff 5.

It should be noted that the terminology "operably coupled" used herein to describe the relationship between the anchor point 2 and the cuff 5 should be construed generally that the cuff 5 secures the glove 1 tightly around the wrist of the user such that when the anchor point 2 is pulled by the tool, the cuff 5 secures the glove 1 from being pulled from the hand of the user by the anchor point 2 and/or distributes the forces so as to reduce the likelihood of injury.

In this regard, in embodiments, the anchor point 2 is coupled to the cuff 5 (such as in the embodiment shown in FIG. 1) whereas, in other embodiments, the anchor point 2 is not fastened to the cuff 5, rather spaced from the cuff 5 by an intervening portion (as is substantially shown in FIG. 6) wherein however, for the latter, the operable coupling of the anchor points 2 and the tightenable cuff 5 remains the same in that the tightenable cuff 5 prevents or reduces the likelihood of the glove 1 from being yanked from the hand of the user when the anchor point 2 is pulled by the tool.

Figure 5:
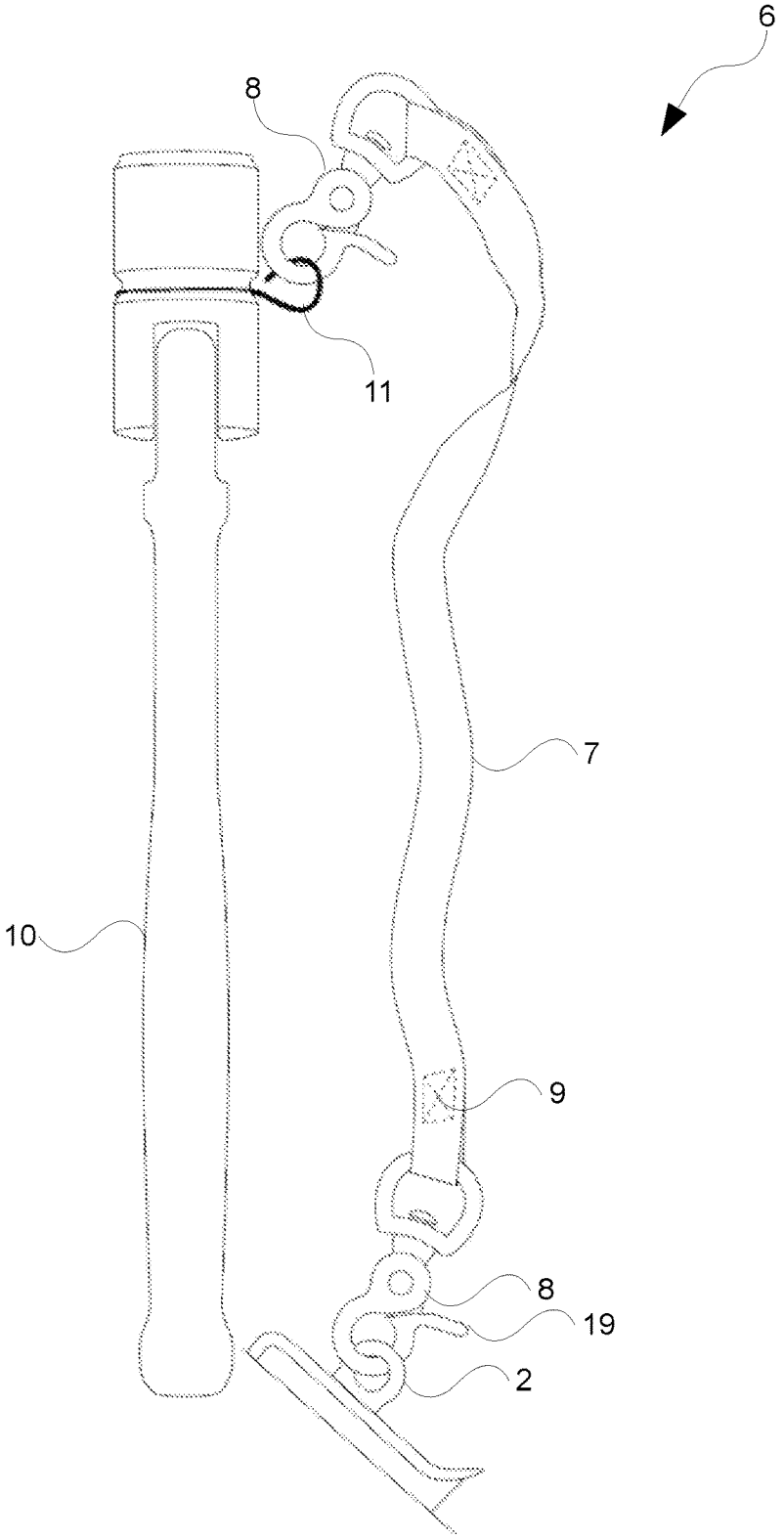
FIG. 5 shows a lanyard for attachment to a glove for elevated working tool securement in accordance with an embodiment of the present disclosure.

Turning now to FIG. 5, there is shown an exemplary lanyard 6 which may be utilised for tethering a tool to the glove 1. Specifically, as can be seen, the lanyard 6 comprises an elongate strap 7 which may be manufactured from a flexible material such as polyester or the like having the desired breaking strain tolerance. To at least one side, or both sizes as is substantially shown in FIG. 5, releasable clasps 8 may be attached to the strap 7. A first end of the lanyard 6 is directly attached to the anchor point 2 of the glove. In the embodiment shown, one clasp 8 is releasably and directly attached to the anchor point 2 of the glove 1, whereas the other distal clasp 8 is fastened to a tool 10 such as by way of a tether 11.

The strap 7 may be double stitched 9 at either end to form a loop to engage the associated clasps 8.

Furthermore, in the embodiment shown, the clasps 8 are swivelable so as to reduce the tangling and/or twisting of the strap 7. Furthermore, the clasp 8 may comprise a gate lever 19 for opening and closing the clasps 8 which gate lever 19 may be sufficiently pronounced so as to be operable by the user while gloved.

Turning again to the embodiment shown in FIGS. 1 and 2, as can be seen, the tightenable cuff 5 comprises a releasably fastenable offset adjustment band 4 which may be released for offset adjustment to tighten the cuff 5. In this manner, in use, the user may release the band 5 and insert a hand into the glove 1 whereafter, once inserted, the user fastens the band 4 by wrapping the band 4 around the wrist so as to tighten the cuff 5. In the embodiment shown in FIG. 5, the band 5 may comprise hook fasteners that engage with corresponding loop fasteners on a corresponding band fastening portion of the cuff 5.

In this embodiment, the cuff 5 may be strengthened so as to be suited for tightening in the manner described herein. In this regard, the cuff 5 may be double walled, manufactured from a more resilient material as compared to the remainder of the glove 1 or the like such that when the band 4 is tightened in the manner described above, the cuff 5 comprises sufficient resilience so as to tighten around the wrist of the user within the purposive scope of the embodiments described herein of being operably coupled to the anchor point 2.

In the embodiment shown in FIG. 1, the anchor point 2 takes the form of a material loop 2 extending forwardly from the cuff 5. As such, in use, the clasp 8 of the aforementioned lanyard 6 may be engaged via the loop 2.

In one embodiment described herein, the loop 2 is configured for securing 20 N or more so as to be suited for securing conventional tool types if dropped. However, testing by the Inventor of at least one embodiment disclosed herein revealed that the glove 1, in embodiments, may withstand over 400 N.

In preferred embodiments, the glove 1 is made from sufficiently strong material so as to be able to withstand such forces and resist against tearing.

As is also shown in FIG. 1, the loop 2 is held in place by an anchor point retainer 3. In the embodiment shown in FIG. 1, the loop 2 and the anchor point retainer 3 may be integrally formed from an elongate piece of material which is folded double such that the distal end forms the loop 2 and the proximal ends stitched to the cuff 5. The anchor point retainer 3 may be doubly stitched to adequately secure the loop 2 to the cuff 5.

In the embodiment shown in FIG. 2, the cuff 5 may be double stitched along the proximal edge 14.

Furthermore, a side of the cuff 5 opposite the band 4 may widen, such as by protruding rearwardly, as shown for reasons including providing greater tensioning surface area against the wrist of the user opposite the band 4.

In the embodiment shown in FIGS. 1 and 2, the anchor point 2 may be located on the front or back of the glove 2. However, in preferred embodiments as will be described in further detail below particular with reference to FIG. 6 onwards, the anchor point 2 is located at the back of the glove 1.

Figure 3:
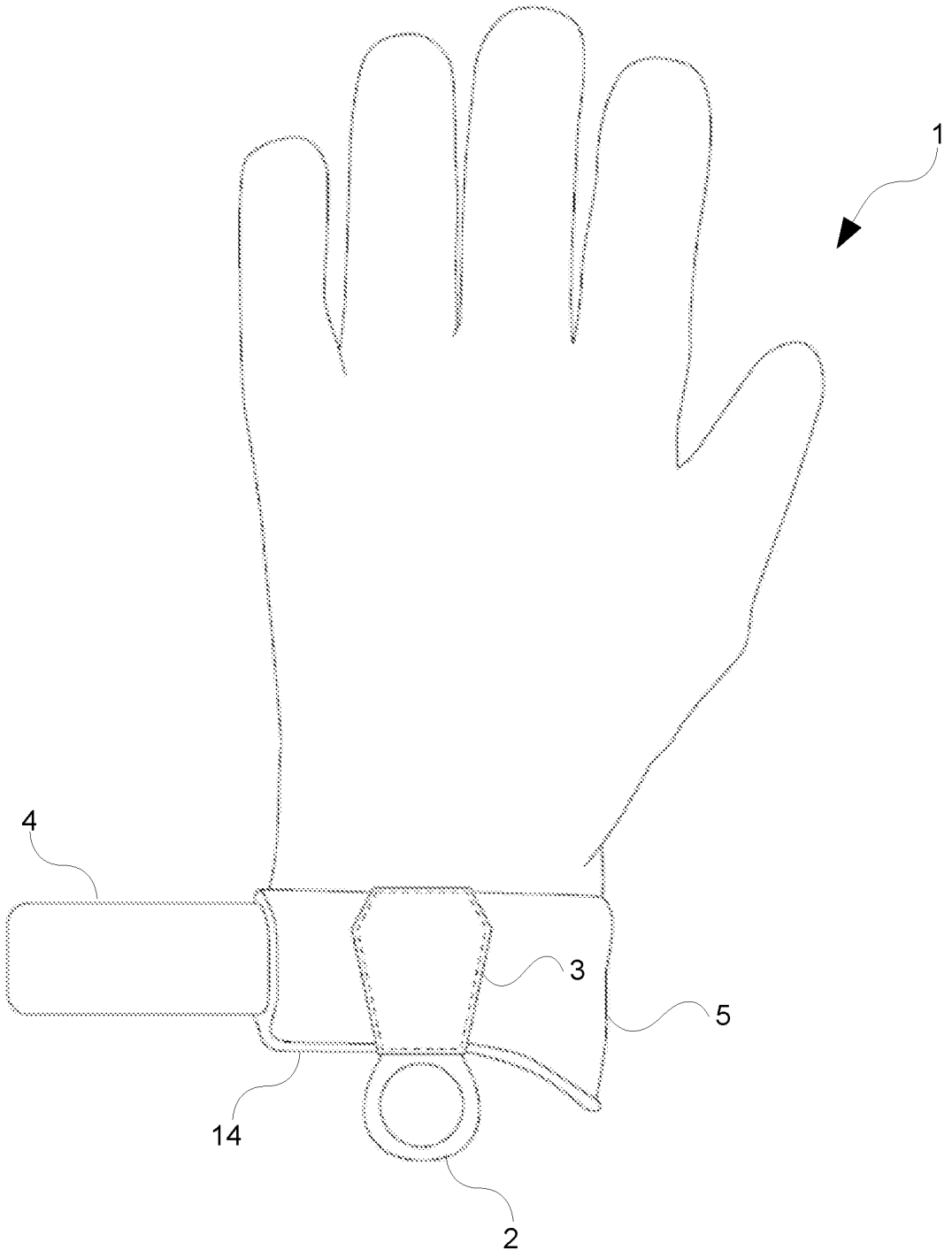
FIGS. 3 and 4 show front and back views of a glove for elevated working tool securement in accordance with a further embodiment of the present disclosure.
Figure 4:
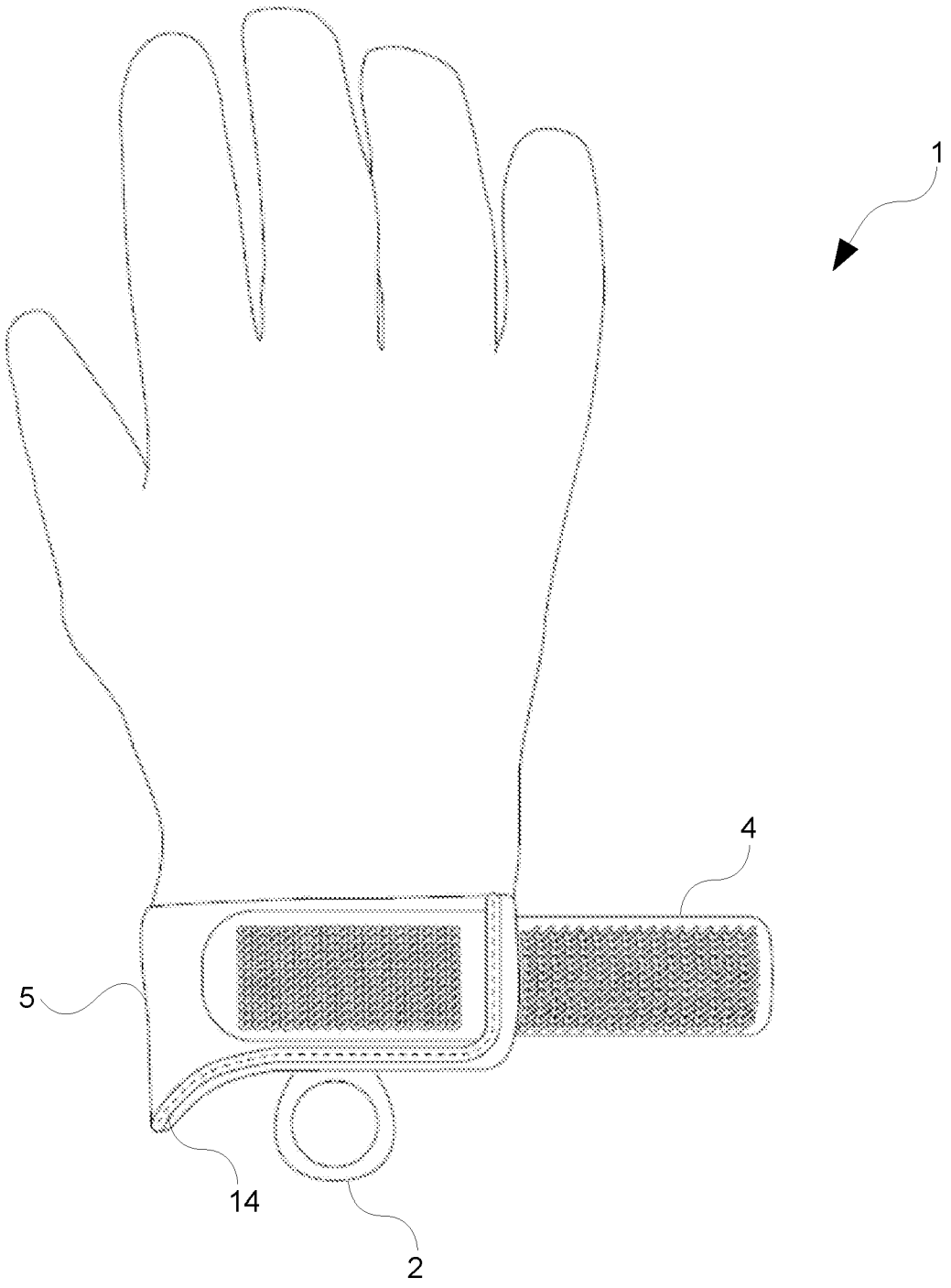

Turning now to FIGS. 3 and 4, there is shown a further embodiment of the glove 1 wherein, the glove 1 shown is characterised from the glove 1 shown in FIGS. 1 and 2 in that the anchor point 2 extends rearwardly. Furthermore, as opposed to the anchor point 2 being formed by a loop of material, the anchor point 2 takes the form of pull tab 2 having a circular aperture therein and being substantially coplanar with the adjacent portion of the cuff 5. The pull tab 2 may be manufactured from a suitably resistant material, such as sufficiently strengthened plastic, metal or the like. In embodiments, the pull tab 4 may be formed from a loop of cord.

Furthermore, the anchor point retainer 3 dilates laterally forwardly increasing the contact area with the cuff 5 while meeting at the neck of the anchor point 2. Where the anchor point 2 takes the form of the above-mentioned plastic or metal pull tab 2, the distal portion of the pull tab 2 may be stitched beneath an anchor point retainer material covering.

Figure 6:
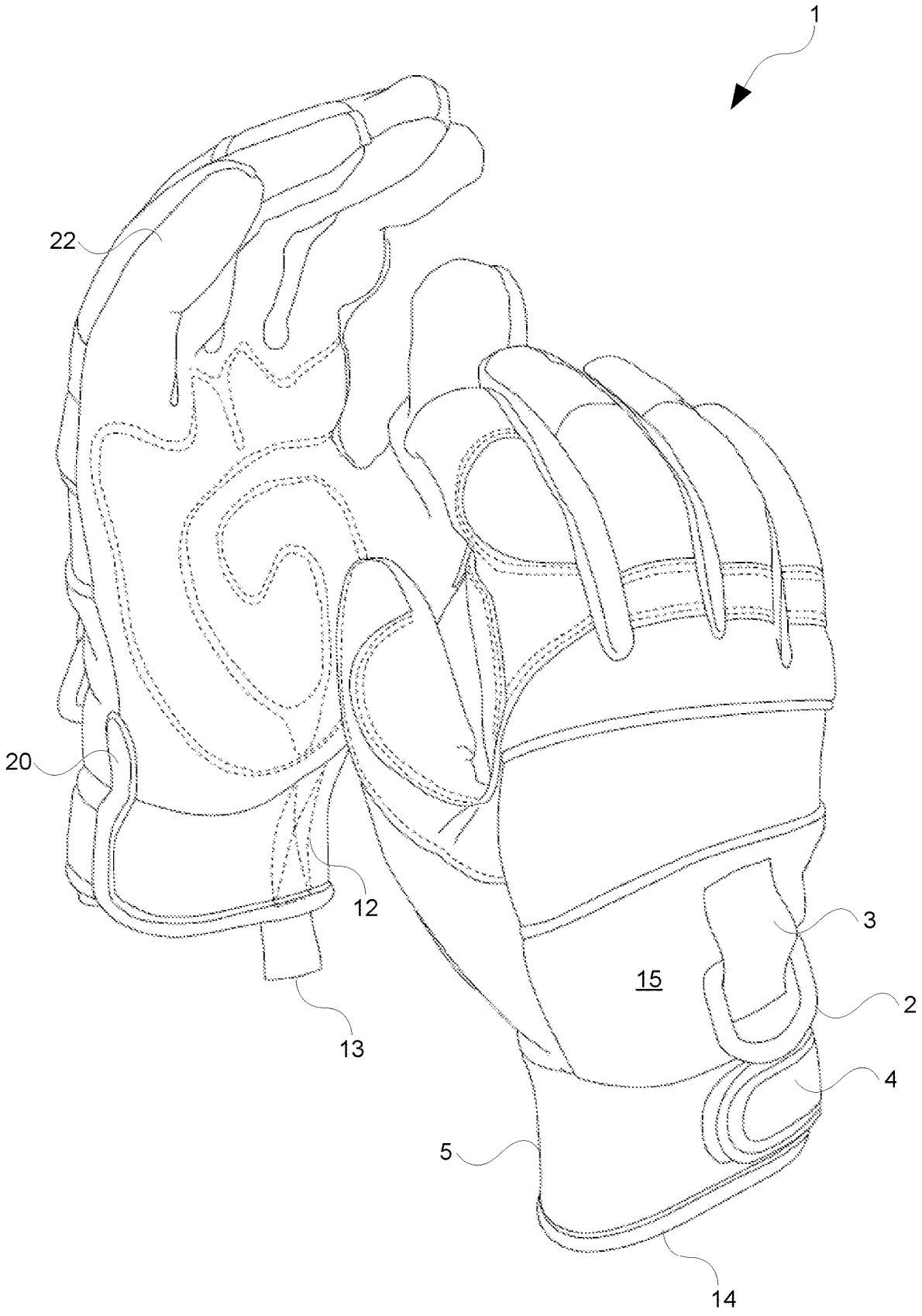
FIG. 6 shows front and back perspective views of a pair of gloves for elevated working tool securement in accordance with a preferred embodiment of the present disclosure.

Turning now to FIG. 6, there is shown a first of a series of preferred embodiments showing top perspective views of a pair of gloves 1 illustrating front and back aspects thereof.

In this embodiment, the working faces 22 of the glove 1 may comprise insulative and/or grip enhancing surfaces which, in embodiments, may be stitched to the gloves 1 for securement.

Now, as can be seen, and as alluded to above, in this preferred embodiment, the anchor point 2 is located at the back of the glove 2. In this manner, the anchor point 2 does not needlessly interfere with the frontward working face of the glove 2. In this regard, the lanyard 6 may extend laterally around the wrist for fastening to the back of the glove 2 by the rearwardly positioned anchor point 2.

In the embodiment shown, the anchor point 2 takes the form of a D-ring generally defining a straight portion engaged by the anchor point retainer 3 and a curved portion 2 for securement by the clasp 8 or other means.

As can be seen, the anchor point 2 is located at a portion, referred to herein for illustrative convenience as a proximal rearward portion 15, that is, in general terms, in a preferred embodiment, the anchor point 2 is located more proximally then distally (i.e. closer to the wrist) with reference to the glove 1.

In the embodiment shown, and as alluded to above, the anchor point retainer 3 is not fastened to the cuff 5 itself but rather operably coupled to the cuff 5 in the manner described above: that is, wherein, when the anchor point 2 is pulled by the lanyard 6, the anchor point 2 is retained by the anchor point retainer 3 which pulls the proximal rearward portion 15 of the glove 1 which in turn pulls against the cuff 5 which is tightened around the wrist of the user for securement.

In the embodiment shown, the anchor point retainer 3 is formed from a short elongate strip of material which is stitched either end of the straight portion of the D-ring anchor point 2 along the proximal distal axis to the proximal rearward portion 15. The spacing of the stitching and the length of the strip of material of the anchor point retainer is sufficient to allow the D-ring anchor point 2 to purposively swivel without allowing for excessive play.

Furthermore, as can be seen from this embodiment, the band 4 tightens around the edge of the cuff 5 opposite the thumb.

Furthermore, in the embodiment shown, the glove 1 may comprise a frontwardly located proximally extending pull tab 15 suited for assisting the donning of the gloves 5 which pull tab 15 may be further strengthened by adjacent cross stitching 12 through the cuff 5.

As can also be seen, the cuff 5 may be formed by a distally projecting slit 5 located on the side opposite the thumb in the embodiment shown thereby defining to adjacent cuff portions which are selectively offset adjustable with respect to each other for tightening the cuff wherein the band 4 is fastened to one of the adjacent cuff portions for extending across the slit 5 for fastening to the band fastening portion located on the rear of the wrist as is shown.

Figure 7:
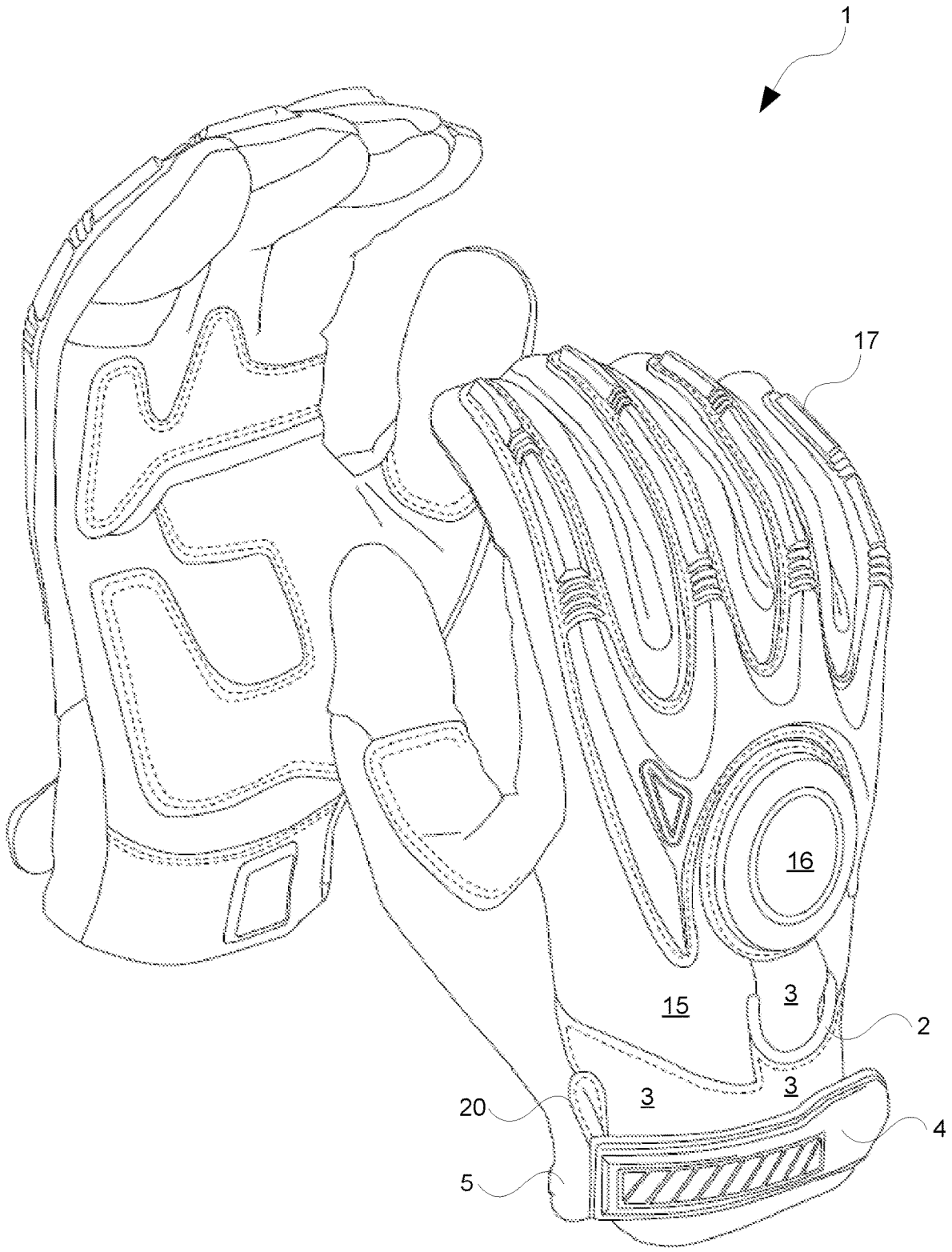
FIG. 7 shows front and back perspective views of a pair of gloves for elevated working tool securement in accordance with a further preferred embodiment of the present disclosure.

Turning now to FIG. 7, there is shown a further preferred embodiment wherein, as can be seen, the glove 1 takes on a more ruggedised construction including in that it may comprise a rearward rubberised guards 15 protecting the exterior of the fist.

Furthermore, as can be seen, in the embodiment shown, the anchor point 2 may yet take the form of the D-ring retained by the proximally-distally orientated anchor point retainer 3.

However, in the embodiment shown, the anchor point 3 is distinguished from the anchor point 3 of the embodiment shown in FIG. 6 in that the proximal end of the anchor point retainer 3 may form part of the cuff 5. Specifically, as can be seen, as the anchor point retainer 3 transitions proximally, it may extend laterally and underneath the band 4 so as to form part of the cuff 5. As such, in this embodiment, the anchor point 2 is coupled to the cuff 4 and that the anchor point retainer 3 securing the anchor point is integrally formed with the cuff 5.

Furthermore, the distal end of the anchor point retainer 3 may be stitched beneath a rearward surface feature/guard 16 of the glove which, in the embodiment shown, may be substantially circular.

In this embodiment, the distal end of the anchor point retainer 3 may be stitched beneath the guard 16 and, in embodiments, the anchor point retainer 3 may similarly widen at the distal end so as to occupy greater surface area beneath the rubberised guard 16.

The rubberised guard 6 may serve dual purposes in providing a rubberised bumper or guard for the rearward aspect of the glove 1 and provide additional securement for the distal end of the anchor point retainer 3.

As can be appreciated from the aforedescribed anchor point retainer 3 arrangements, the forces exerted via the anchor point retainer 3 while the anchor point 2 is pulled during a tool drop event is spread across a greater rearward area of the glove wherein, specifically, the forces spread across the proximal end of the anchor point retainer 3 which spreads laterally and forms part of the cuff 5 and also the distal end of the anchor point retainer 3 which extends beneath the rubberised guard 16.

In the embodiment shown, in distinction to the embodiment provided in FIG. 6, the band 4 extends from the thumb side of the glove 1 wherein the aforementioned slit 20 is located on the thumb side.

In this embodiment, the rear portion of the band 4 may itself be rubberised for further resilience and protection.

Figure 8:
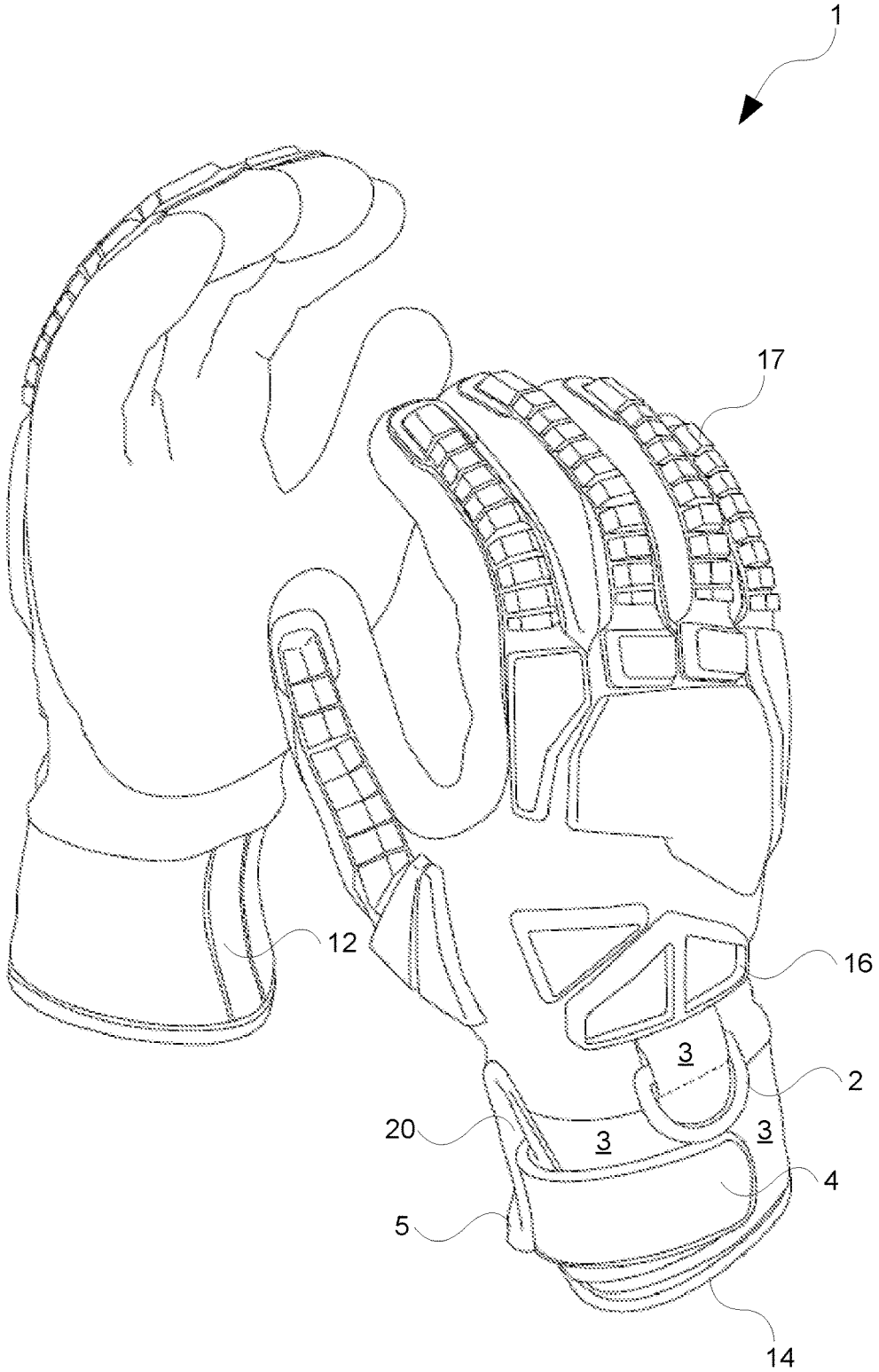
FIG. 8 shows front and back perspective views of a pair of gloves for elevated working tool securement in accordance with a further preferred embodiment of the present disclosure.

Turning now to FIG. 8, there is shown a further preferred embodiment substantially similar to the embodiment provided above in FIG. 7. Specifically, in the embodiment shown in FIG. 8, the glove 1 is similarly ruggedised by comprising rearward surface protection guards 17, such as by way of rubberised nodules to protect the closed fist of the wearer.

However, in this embodiment, the rubberised guard 16 takes on a different configuration wherein, as can be seen, as opposed to being substantially circular as described with reference to FIG. 7, the rubberised guard 16 extends laterally.

As such, in this manner, the proximal end of the anchor point retainer is similarly integrally formed with the rearward surface of the cuff 5 and the distal portion of the anchor point retainer 3 is trapped beneath the guard 16 thereby conferring force distribution and pull resilience properties to the glove 1.

Figure 9:
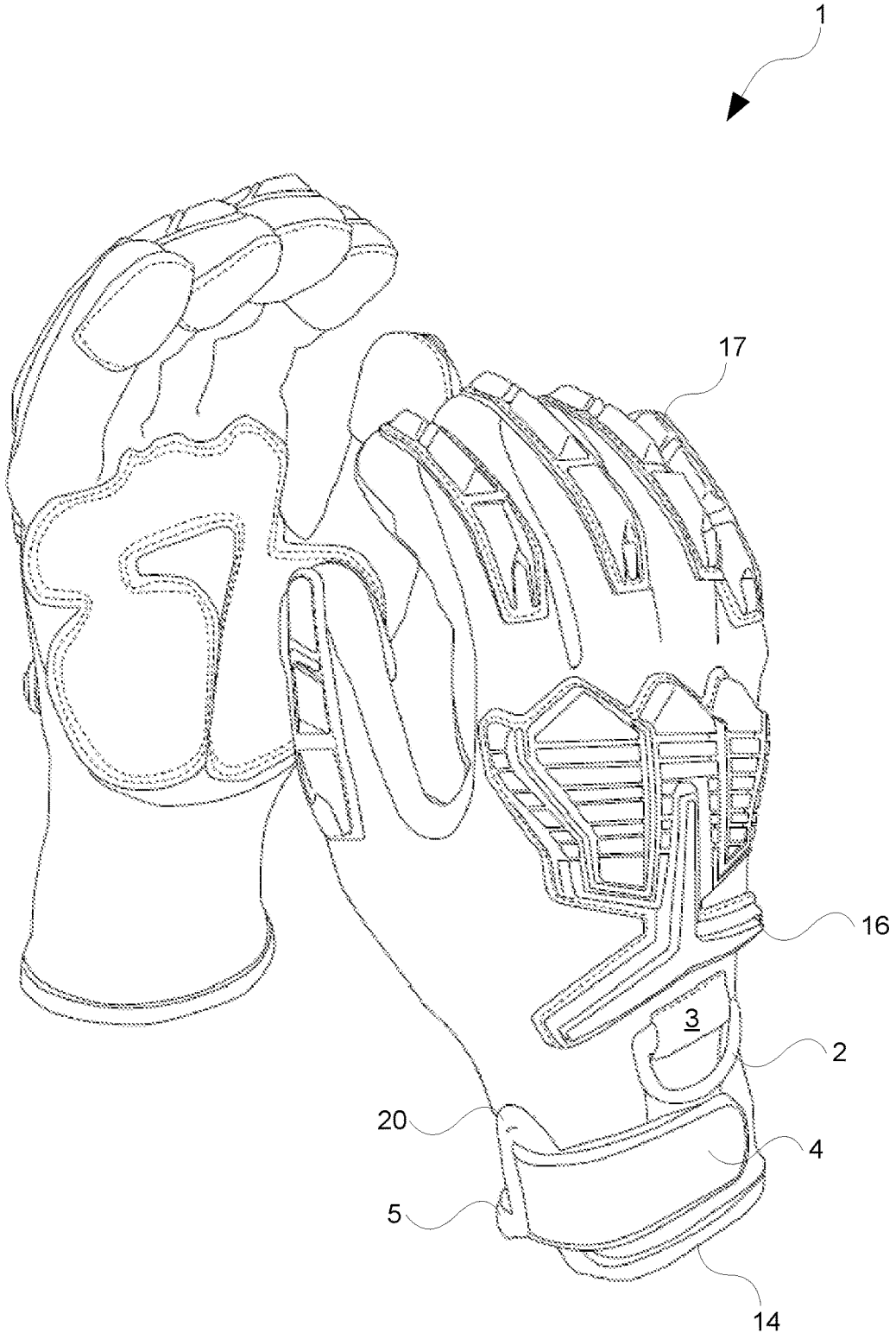
FIG. 9 shows front and back perspective views of a pair of gloves for elevated working tool securement in accordance with a further preferred embodiment of the present disclosure.

Turning now to FIG. 9, there is shown a yet further embodiment of the glove 1 wherein the glove 1 is similarly ruggedised as was described with reference to FIGS. 7 and 8. FIG. 9 shows the rearward surface feature/guard 16, which may be called a surface guard 16, positioned on the back of the glove 1, with the anchor point retainer 3 being spaced apart from the surface guard 16 and fastened to the cuff 5.

In this embodiment, the glove embodiment shown is characterised in that the anchor point retainer 3 is fastened only to the proximal side to the cuff 5. As such, in this manner, when the anchor point 2 is pulled, as opposed to the anchor point retainer 3 pulling at either end of the anchor point 2 in the manner described above, the anchor point retainer 3 pulls proximally only against the cuff 5 such that substantially all of the force is borne by the tightened cuff 5.

Interpretation

Embodiments

Reference throughout this specification to "one embodiment" or "an embodiment" means that a particular feature, structure or characteristic described in connection with the embodiment is included in at least one embodiment of the present invention. Thus, appearances of the phrases "in one embodiment" or "in an embodiment" in various places throughout this specification are not necessarily all referring to the same embodiment, but may. Furthermore, the particular features, structures or characteristics may be combined in any suitable manner, as would be apparent to one of ordinary skill in the art from this disclosure, in one or more embodiments.

Similarly it should be appreciated that in the above description of example embodiments of the invention, various features of the invention are sometimes grouped together in a single embodiment, figure, or description thereof for the purpose of streamlining the disclosure and aiding in the understanding of one or more of the various inventive aspects. This method of disclosure, however, is not to be interpreted as reflecting an intention that the claimed invention requires more features than are expressly recited in each claim. Rather, as the following claims reflect, inventive aspects lie in less than all features of a single foregoing disclosed embodiment. Thus, the claims following the Detailed Description of Specific Embodiments are hereby expressly incorporated into this Detailed Description of Specific Embodiments, with each claim standing on its own as a separate embodiment of this invention.

Furthermore, while some embodiments described herein include some but not other features included in other embodiments, combinations of features of different embodiments are meant to be within the scope of the invention, and form different embodiments, as would be understood by those in the art. For example, in the following claims, any of the claimed embodiments can be used in any combination.

Different Instances of Objects

As used herein, unless otherwise specified the use of the ordinal adjectives "first", "second", "third", etc., to describe a common object, merely indicate that different instances of like objects are being referred to, and are not intended to imply that the objects so described must be in a given sequence, either temporally, spatially, in ranking, or in any other manner.

Specific Details

In the description provided herein, numerous specific details are set forth. However, it is understood that embodiments of the invention may be practiced without these specific details. In other instances, well-known methods, structures and techniques have not been shown in detail in order not to obscure an understanding of this description.

Terminology

In describing the preferred embodiment of the invention illustrated in the drawings, specific terminology will be resorted to for the sake of clarity. However, the invention is not intended to be limited to the specific terms so selected, and it is to be understood that each specific term includes all technical equivalents which operate in a similar manner to accomplish a similar technical purpose. Terms such as "forward", "rearward", "radially", "peripherally", "upwardly", "downwardly", and the like are used as words of convenience to provide reference points and are not to be construed as limiting terms.

Comprising and Including

In the claims which follow and in the preceding description of the invention, except where the context requires otherwise due to express language or necessary implication, the word "comprise" or variations such as "comprises" or "comprising" are used in an inclusive sense, i.e. to specify the presence of the stated features but not to preclude the presence or addition of further features in various embodiments of the invention.

Any one of the terms: including or which includes or that includes as used herein is also an open term that also means including at least the elements/features that follow the term, but not excluding others. Thus, including is synonymous with and means comprising.

SCOPE OF INVENTION

Thus, while there has been described what are believed to be the preferred embodiments of the invention, those skilled in the art will recognize that other and further modifications may be made thereto without departing from the spirit of the invention, and it is intended to claim all such changes and modifications as fall within the scope of the invention. For example, any formulas given above are merely representative of procedures that may be used. Functionality may be added or deleted from the block diagrams and operations may be interchanged among functional blocks. Steps may be added or deleted to methods described within the scope of the present invention.

Although the invention has been described with reference to specific examples, it will be appreciated by those skilled in the art that the invention may be embodied in many other forms.

INDUSTRIAL APPLICABILITY

It is apparent from the above, that the arrangements described are applicable to the personal protective equipment industries.

The invention claimed is:

1. A work glove for a user's hand and configured to secure tools used in elevated working environments, the work glove comprising:

a finger section, a palm section, a back of glove, and a cuff;

the work glove configured to receive the user's hand with the finger section configured to completely cover the user's fingers, the palm section configured to cover the user's palm, the back of glove configured to cover the user's back of hand and the cuff configured to surround the user's wrist; and an anchor point retainer having a proximal end and a distal end opposite the proximal end, the anchor point retainer securing an anchor point between the proximal end and the distal end, wherein the proximal end of the anchor point retainer is fastened only to the cuff, and the distal end of the anchor point retainer is connected to the back of glove at a position spaced apart from the cuff to hold the anchor point between the cuff and the finger section, and wherein the anchor point retainer is configured to transmit substantially all of a pulling force from the anchor point to the cuff.

2. The work glove of claim 1, wherein said cuff is a tightenable cuff configured to be tightened about the user's wrist.

3. The work glove of claim 2, wherein said anchor point retainer extends under said tightenable cuff.

4. The work glove of claim 1, wherein said anchor point retainer extends along a longitudinal axis of said work glove.

5. The work glove of claim 1, wherein said anchor point includes a D-ring.

6. The work glove of claim 1, wherein the work glove further includes a surface guard positioned on said back of glove, and wherein the surface guard is spaced from the anchor point.

7. The work glove of claim 6, wherein said anchor point retainer is spaced apart from said surface guard.

8. The work glove of claim 1, wherein the anchor point retainer includes a strip of material oriented along a distal-proximal axis of the work glove.

9. The work glove of claim 1, wherein at least one of said distal end or said proximal end of said anchor point retainer is stitched to a portion of the work glove.

10. The work glove of claim 1, wherein said proximal end of said anchor point retainer is integrally formed with said cuff.

11. A system for use in elevated working environments, comprising:

the work glove of claim 1; and a lanyard having an elongated strap of flexible material with a releasable clasp connected to an end thereof, and wherein the lanyard is further configured to connect to a tool at another end of the elongated strap, opposite from the releasable clasp, wherein the releasable clasp is configured to be attached to the anchor point of the glove.

12. The system of claim 11, wherein the lanyard further includes another releasable clasp attached to the elongated strap, opposite from the releasable clasp, and wherein the another releasable clasp is configured for releasable attachment to the tool.

13. A method for tool securement at elevated heights, comprising:

wearing, by a user, the work glove of claim 1;

attaching, by a lanyard having an elongated strap of flexible material, a tool to the anchor point of the work glove; and dropping the tool, causing the lanyard to exert the pulling force on the anchor point of the work glove.

14. The method of claim 13, wherein attaching the tool to the anchor point of the work glove includes operating a releasable clasp of the lanyard to selectively couple the lanyard to the work glove.

15. The method of claim 13, wherein attaching the tool to the anchor point of the work glove includes operating a releasable clasp of the lanyard to selectively couple the lanyard to a tether of the tool.

* * * * *